United States Patent [19]

Yang

[11] Patent Number: 4,819,924

[45] Date of Patent: Apr. 11, 1989

[54] HEAVY DUTY VISE

[76] Inventor: Tai-Her Yang, 5-1 Taipin St., Si-Hu Town, Dzan-Hwa, Taiwan

[21] Appl. No.: 133,658

[22] Filed: Dec. 16, 1987

[51] Int. Cl.[4] ..... B25B 1/10

[52] U.S. Cl. ..... 269/241; 269/136

[58] Field of Search ..... 269/241, 242, 246, 134, 269/136, 138

[56] References Cited

U.S. PATENT DOCUMENTS 410,815 9/1889 Tarbell ..... 269/241

*Primary Examiner*—Robert C. Watson

*Attorney, Agent, or Firm*—Leonard Bloom

[57] ABSTRACT

A heavy duty vise having a base, a fixed jaw and an upstanding boss formed integrally with the base and movable jaw which has limited reciprocating movement between the boss and the fixed jaw. A threaded hole is formed in the boss and a cylindrical sleeve with cooperating fine threads on its outer diameter extends through the hole. The sleeve extends outwardly to a handle. A rod passes through the sleeve and has a forward end on which the movable jaw is carried. The rod has coarse threads formed thereon which cooperate with coarse threads on the inner diameter of the cylindrical sleeve. The rod also has a handle extending outwardly beyond the sleeve. Rotation of the rod handle provides coarse adjustment of the movable jaw and rotation of the sleeve handle provides fine adjustment of the movable jaw.

4 Claims, 2 Drawing Sheets

HEAVY DUTY VISE

SUMMARY OF THE INVENTION

The application of clamping with same shafts of penetrating the coupling multiple drive, we performed, is not hydraulic. The clamping such as, the mechanical chuck tong in tooling machine, is used to hammering its chuck-hand so as to fasten the work effectively. Not only the tong and the machine are easily damaged, but also the steady level of reproduction size is usually motioned. The design is to put a ring nut in between the lead screw and its carrying bar. The ring nut outside has narrower pitch distance and inside has rougher thread distance, which is to be coupling with the lead screw.

The spiral direction inside is negative to that of outside. The ring nut can be drived. Therefore, when the normal lead screw drives the sporting piece to press upon the work, this can produce multiple drive effect caused by multiple nut.

BRIEF DESCRIPTION OF THE DRAWINGS

FIG. 1-1 is the sectional view of a real example for the lead screw, motion type, with same shafts coupling multiple drive, to be put into practice of chuck tong.

FIG. 2-1 is a sectional view of a real example for the lead screw, fixed type, with same shafts coupling multiple drive, to be put into practice of chuck tong.

DETAILED DESCRIPTION OF THE INVENTION

Since the work before being reproduced by various ways such as anvil, plane, mill, weld, saw, file, grind etc., should be fastened by clamping, many kinds of clamping have been developed for thousands of years. Recently, to specify raising the clamping effect, there are hydraulic clamping or smaller pitch distance thread to be designated as to meet the requirements. Nevertheless, it was found that, the hydraulic type is too expensive while the smaller pitch distance thread is defected with the slow speed of drive. Although the chuck tong has been improved by the people, the improvement seems to be not perfect enough to meet people's needs.

Figure 1:
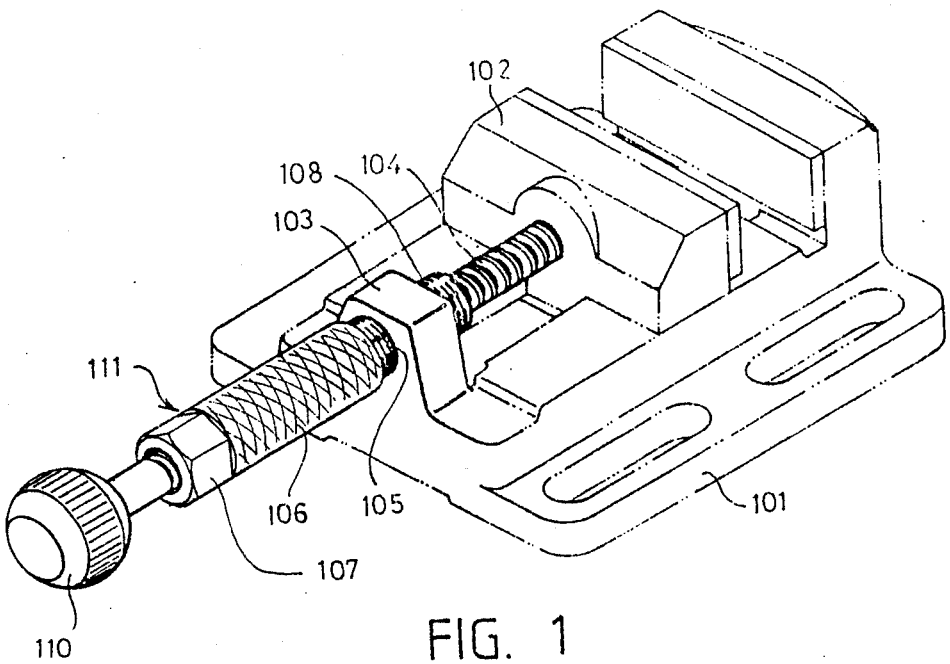
FIG. 1 is the perspective view of a real example for the lead screw, motion type, with same shafts coupling multiple drive, to be put into practice of chuck tong.
Figure 1:
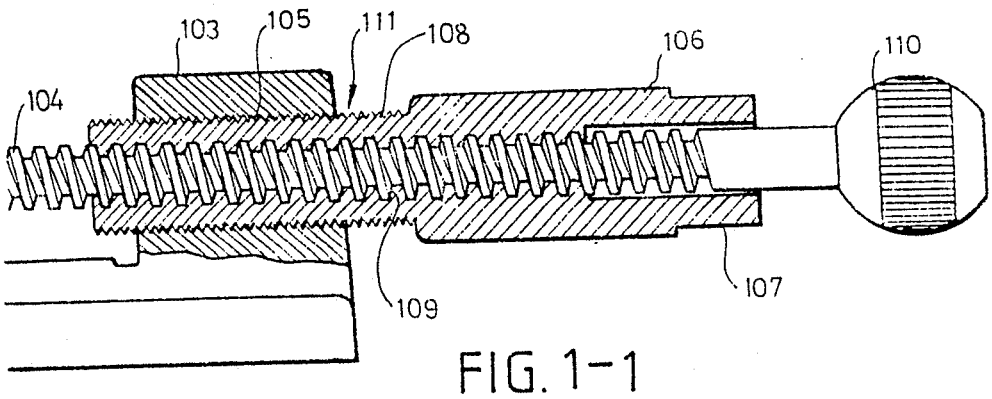

Since that, the applicant is motivated by his work recognition of professional production to design the said application of clamping with same shafts penetrating the coupling with the multiple drive, and complete the easy but effective design as to make the larger pitch distance lead screw penetrate coupling with the smaller pitch distance lead screw and to be separately drived. The description hereunder relates to the design for the application of motioned type lead screw and fixed type lead screw to be put into practice of chuck tong. FIG. 1 and FIG. 1-1 refer to the chuck tong emodidment (base) 101 with a lead rail to allow the sporting piece (movable jaw) 102, drived by the lead screw (elongated rod) 104, to slide back and forth. There is a carrying bar (upstanding boss) 103 on the other end of the embodiment, and on the bar, there is a horizontal reverse thread spindle with fine pitch to be screwed into the multiple thread ring (cylindrical sleeve); the multiple thread ring 111 looks like a shape of a tub, and its interior spindle is the inside thread spindle (coarse threads) 109 to be coupling with lead screw 104, and on the one of its outer ring ends there has a thread ("fine" threads on sleeve) 108 with reverse multiple fine pitch thread spindle ("fine" threads about hole in boss) 105 of carrying bar 103, and on the other end there is the multiple performing handle (sleeve handle) 106 outside with embossing press or the multiple nut 107 with coupling wrench to be multiple drived by hand or wrench; the one end of said drive lead screw 104 coupling with a sporting piece, and the other end coupling with a adjusting handle (rod handle) 110 to be drived by hand; the thread pitch distance of the said drive lead screw is larger than that of multiple thread, and their spiral directions are negative.

Figure 2:
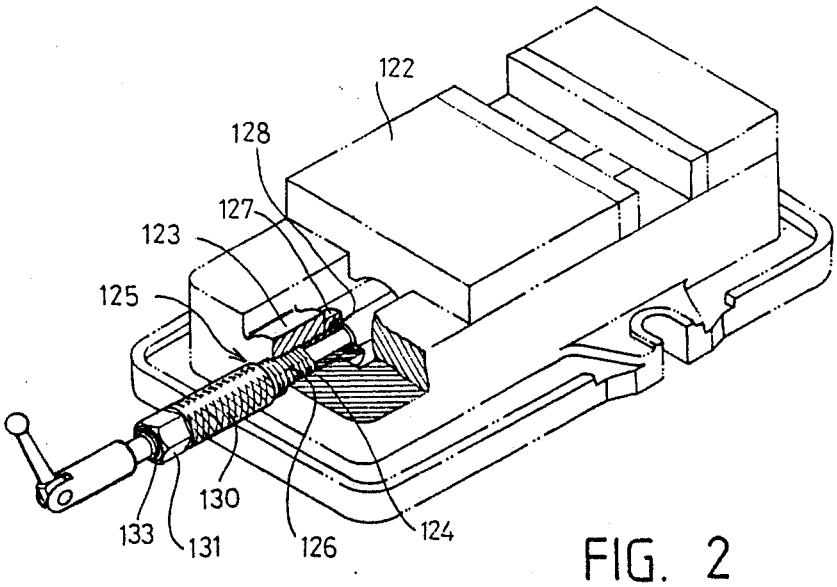
FIG. 2 is the perspective view of a real example for the lead screw, fixed type, with same shafts coupling multiple drive, to be put into practice of chuck tong.
Figures 1, 2:
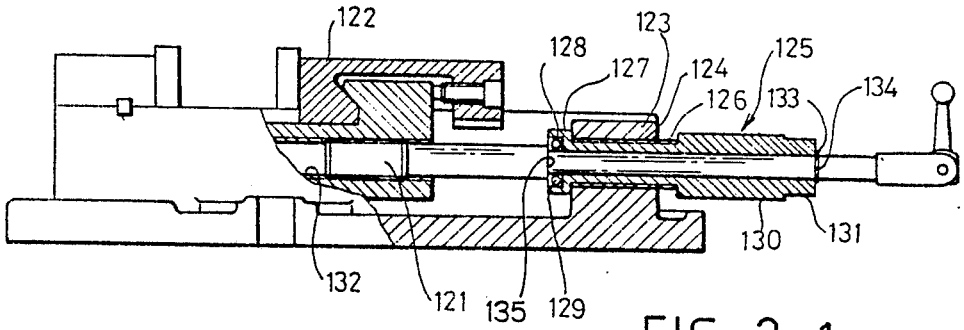

Performing the chuck press, we can use the adjusting handle 110 to drive the sporting piece forward. In order to make the sporting piece in production of much more drive we can screw the multiple thread ring to produce much more push power by hand or wrench. When it is to be released and backwards, we can, with our hands or wrench, make the multiple thread ring to be loosed and backwards at first, and then to use the adjusting handle. FIG. 2 and 2-1 relate to the other types of application example, which is the fixed lead screw type, that is, the lead screw (elongated rod) 121 has the slide adjusting relationship with sporting piece (movable jaw) 122 and has a fixed close-pressing relationship with carrying bar (upstanding boss) 123. Such kind of construction type is the same as real example 1, that is, the carrying bar 123 has a smaller pitch distance in inside thread spindle (cylindrical sleeve) 124. Nevertheless, its spiral direction between lead screw 121 can be the same or reversed, with the characteristics as follows:

The same shaft multiple thread ring (cylindrical sleeve) 125 external with thread ("fine" threads on sleeve) 126, to be coupling with carrying bar thread spindle 124. The carrying bar interiored with a larger flange of ring construction (collar) 127, and has a ladder straight spindle (blind axial bore) 128 to be put into the locking drive (thrust) bearing 129. The end of the extension has a helical (cylinder) handle 130 and the multiple nut 131 to be coupling with the wrench, which is connected with the said construction, lead screw 121, to be coupling with the thread spindle (coarse threads) 132 of motioned piece (movable jaw) 122, and the other end appears a shape of reducing ladder. The sectional side of the ladder is to be pressed for locking drive bearing 129, and the section with smaller diameter to be penetrated by multiple thread ring 125, and to be fixed on its groove 134 by lock ring 133; when drived by lead screw 121, the slide piece is made to move forward due to the fixed function of locking drive bearing 129. And to press by turning multiple thread ring 125 in a further step; to release it just an easy performance only needed.

Judging from the above-mentioned description, we are concluded that this design is to be the application of clamping on machinery h chuck tong in practical performance, which can chuck and fasten the work with higher efficency, as well as to make the reproduction safe and cutting result steady. Please check and refer to this design in accordance with the regulations.

What is claimed is:

1. A heavy duty vise comprising a base, a fixed jaw formed integrally with the base, an upstanding boss formed integrally with the base and spaced from the fixed jaw, a movable jaw guided for limited reciprocating movement substantially between the boss and the fixed jaw, the boss having a hole formed therein, a cylindrical sleeve having an outer diameter provided with fine threads cooperating with internal threads formed in the hole in the boss, the sleeve having a portion extending outwardly of the boss beyond the base and having a sleeve handle carried by the outwardly extending portion of the sleeve, an elongated rod passing through the sleeve and having a forward end portion on which the movable jaw is carried, the elongated rod being provided with coarse threads, the elongated rod extending outwardly of the base and beyond the handle on the sleeve, and a rod handle carried by the outwardly extending portion of the elongated rod, such that rotation of the rod handle provides coarse adjustment of the movable jaw, and such that rotation of the sleeve handle provides fine adjustment of the movable jaw.

2. A heavy duty vise comprising:

a base;

a fixed jaw formed integrally with the base;

an upstanding boss formed integrally with the base and spaced apart from the fixed jaw;

the boss having a circular hole formed therein, and the hole being provided with internal "fine" threads, having a given pitch;

a movable jaw guided on the base for limited reciprocatory movement thereon between the boss and the fixed jaw;

a cylindrical sleeve having a portion thereof extending through the hole in the boss and being provided with external "fine" threads cooperating with the internal "fine" threads in the hole in the boss;

the sleeve extending outwardly from the boss beyond the base and being provided with a knurled handle thereon;

the sleeve further having an internal cylindrical surface provided with "coarse" threads thereon, the "coarse" threads having a pitch which is the reverse pitch of the "fine" threads;

an elongated rod extending through the sleeve and having "coarse" threads formed thereon cooperating with the "coarse" threads formed within the sleeve;

the elongated rod having an end portion connected to the movable jaw for conjoint movement;

the elongated rod extending outwardly of the sleeve beyond the base and having a handle carried thereon;

the handle on the sleeve being disposed between the boss and the handle on the elongated rod, and the handle on the rod being aligned substantially coaxially with the handle on the sleeve;

whereby rotation of the rod handle produces a "coarse" adjustment of the movable jaw in a given direction relative to the fixed jaw, and whereby counter rotation of the sleeve handle produces a "fine" adjustment of the movable jaw in the same direction relative to the fixed jaw without effecting translational movement of the sleeve relative to the boss;

and whereby the substantial coaxial alignment of the respective handles relative to each other provides a convenient one-handed operation of the vise.

3. A heavy duty vise comprising:

a base;

a fixed jaw formed integrally with the base;

an upstanding boss formed integrally with the base and spaced apart from the fixed jaw;

the boss having a circular hole formed therein, and the hole being provided with internal "fine" threads;

a movable jaw guided on the base for limited reciprocatory movement therein between the boss and the fixed jaw, the movable jaw further having a lower portion with a "coarse" threaded hole formed therein;

a cylindrical sleeve having a first end thereof extending through the hole in the boss and being provided with external "fine" threads cooperating with the internal "fine" threads in the hole in the boss, the first end of the sleeve further having a collar, the collar having a diameter greater than the hole in the boss, the collar further having a blind axial bore formed therein, and a thrust bearing being disposed in the blind axial bore;

the sleeve extending outwardly from the boss beyond the base, and being provided with a knurled handle thereon, of the sleeve having a smooth bore;

an elongated rod having a first end, a mid portion and a second end, the rod extending coaxially through the sleeve, the second end having a handle carried thereon, the mid portion having a shoulder adjacent to the collar on the sleeve, the shoulder extending to the first end of the rod, the first end being inserted in the opening in the lower portion of the movable jaw, the first end having "coarse" threads thereon, and the threads cooperating with the "coarse" threads in the hole in the movable jaw;

whereby rotation of the rod handle produces a "coarse" adjustment of the movable jaw, and whereby rotation of the sleeve handle produces a "fine" adjustment of the movable jaw.

4. The vise of claim 3, wherein the "fine" threads in the hole in the boss and the external "fine" threads on the sleeve have a given pitch, and wherein the "coarse" threads on the elongated rod and "coarse" threads in the hole in the movable jaw have a pitch which is the reverse pitch of the "fine" threads.

* * * * *